US010006452B2

(12) United States Patent
Hirata et al.

(10) Patent No.: US 10,006,452 B2
(45) **Date of Patent: *Jun. 26, 2018**

(54) FLUID CONTROL APPARATUS AND METHOD FOR ADJUSTING FLUID CONTROL APPARATUS

(71) Applicant: Murata Manufacturing Co., Ltd., Nagaokakyo-shi, Kyoto-fu (JP)

(72) Inventors: Atsuhiko Hirata, Nagaokakyo (JP); Kenta Omori, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 301 days.

This patent is subject to a terminal disclaimer.

(21) Appl. No.: 13/951,490

(22) Filed: Jul. 26, 2013

(65) Prior Publication Data

US 2013/0323085 A1 Dec. 5, 2013

Related U.S. Application Data

(63) Continuation of application No. PCT/JP2012/076163, filed on Oct. 10, 2012.

(30) Foreign Application Priority Data

Oct. 11, 2011 (JP) ..... 2011-223594
Apr. 19, 2012 (JP) ..... 2012-095721

(51) Int. Cl.
*F04B 43/04* (2006.01)

(52) U.S. Cl.
CPC ..... *F04B 43/04* (2013.01); *F04B 43/043* (2013.01); *F04B 43/046* (2013.01)

(58) Field of Classification Search
CPC ..... F04B 43/04–43/046; F04B 43/02; F04B 45/047
(Continued)

(56) References Cited

U.S. PATENT DOCUMENTS 4,938,742 A * 7/1990 Smits ..... 604/67
5,569,855 A * 10/1996 Schomburg et al. ..... 73/700
(Continued)

FOREIGN PATENT DOCUMENTS

CN 102979704 A 3/2013
JP 2007-198147 A 8/2007
(Continued)

OTHER PUBLICATIONS

Official Communication issued in International Patent Application No. PCT/JP2012/076163, dated Jan. 15, 2013.

*Primary Examiner* — Alexander Comley
(74) *Attorney, Agent, or Firm* — Keating & Bennett, LLP

(57) ABSTRACT

In a method for adjusting a fluid control apparatus, in a pressing step, a piezoelectric pump is placed on a stage with a cover plate facing upward, the stage is moved up, and a center portion of a principal surface of the cover plate on a side opposite to a diaphragm is pressed with a pressing pin. As a result, the cover plate and the base plate are shaped so as to warp convexly toward the diaphragm side, and a portion joined to a flexible plate is pulled, such that the flexible plate is caused to warp convexly toward the diaphragm side. Thus, residual tensile stress occurs in a movable portion of the flexible plate. Therefore, due to the residual tensile stress, the tensile stress of the movable portion of the flexible plate is increased.

20 Claims, 9 Drawing Sheets

(58) Field of Classification Search
USPC ..... 417/413.2, 111, 413.1, 410.2; 29/888.02; 310/324
See application file for complete search history.

(56) References Cited

U.S. PATENT DOCUMENTS

| | | | | | |
|---|---|---|---|---|---|
| 5,849,125 | A * | 12/1998 | Clark | 156/222 | |
| 5,906,481 | A * | 5/1999 | Ogawa et al. | 417/413.2 | |
| 6,042,345 | A * | 3/2000 | Bishop et al. | 417/322 | |
| 6,060,811 | A * | 5/2000 | Fox et al. | 310/311 | |
| 6,071,087 | A * | 6/2000 | Jalink et al. | 417/322 | |
| 6,162,313 | A * | 12/2000 | Bansemir et al. | 156/163 | |
| 6,343,129 | B1 * | 1/2002 | Pelrine et al. | 381/191 | |
| 7,045,933 | B2 * | 5/2006 | Dollgast | 310/328 | |
| 2005/0053504 | A1 * | 3/2005 | Yamanishi | 417/559 | |
| 2008/0280112 | A1 * | 11/2008 | Langereis et al. | 428/201 | |
| 2009/0148318 | A1 * | 6/2009 | Kamitani | F04B 43/04 | 417/413.2 |
| 2009/0214362 | A1 * | 8/2009 | Kanai | 417/413.2 | |
| 2010/0196177 | A1 * | 8/2010 | Hirata et al. | 417/413.2 | |
| 2011/0070109 | A1 * | 3/2011 | Kanai et al. | 417/410.2 | |
| 2011/0070110 | A1 * | 3/2011 | Hirata | 417/413.2 | |
| 2012/0171062 | A1 * | 7/2012 | Kodama | F04B 43/046 | 417/413.2 |
| 2013/0058810 | A1 | 3/2013 | Hirata et al. | | |
| 2013/0323085 | A1 * | 12/2013 | Hirata et al. | 417/44.2 | |

FOREIGN PATENT DOCUMENTS

| | | | |
|---|---|---|---|
| JP | 2011-027079 | A | 2/2011 |
| WO | 2008/069264 | A1 | 6/2008 |
| WO | 2009/145064 | A1 | 12/2009 |

* cited by examiner

FLUID CONTROL APPARATUS AND METHOD FOR ADJUSTING FLUID CONTROL APPARATUS

BACKGROUND OF THE INVENTION

1. Field of the Invention

The present invention relates to a fluid control apparatus that performs fluid control and a method for adjusting the fluid control apparatus.

2. Description of the Related Art

PCT Publication No. 2008/069264 discloses an existing fluid pump.

FIG. 10 is a diagram showing a pumping action of the fluid pump in PCT Publication No. 2008/069264 in a third-order resonant mode. The fluid pump shown in FIG. 10 includes a pump body 10, a diaphragm 20 fixed at its outer peripheral portion to the pump body 10, a piezoelectric device 23 attached to a center portion of the diaphragm 20, a first opening 11 formed in a portion of the pump body 10 that faces substantially the center portion of the diaphragm 20, and a second opening 12 formed in an intermediate region between the center portion and the outer peripheral portion of the diaphragm 20 or in a portion of the pump body that faces the intermediate region. The diaphragm 20 is made of metal, and the piezoelectric device 23 covers the first opening 11 and does not reach the second opening 12.

In the fluid pump shown in FIG. 10, when a voltage having a predetermined frequency is applied to the piezoelectric device 23, the portion of the diaphragm 20 that faces the first opening 11 and the portion of the diaphragm 20 that faces the second opening 12 flexurally deform in opposite directions. Thus, a fluid is sucked through one of the first opening 11 and the second opening 12 and discharged through the other.

With regard to the fluid pump having a structure as shown in FIG. 10, the structure is simple and it is possible to make the fluid pump thin. Thus, for example, the fluid pump is used as an air-transport pump for a fuel cell system. However, an electronic apparatus into which the fluid pump is incorporated constantly tends to be decreased in size, and thus the fluid pump is required to be further decreased in size without diminishing the capability (flow rate and pressure) of the fluid pump. As the size of the fluid pump is decreased, the capability (flow rate and pressure) of the pump is diminished. Thus, when it is attempted to decrease the size of the pump with its capability maintained, there is a limit on the fluid pump having an existing structure.

Therefore, the inventor of the present application has conceived a fluid pump having a structure described below.

FIG. 11 is a cross-sectional view showing the configuration of a principal portion of the fluid pump. The fluid pump 901 includes a cover plate 95, a base plate 39, a flexible plate 35, a spacer 37, a diaphragm 31, and a piezoelectric device 32, and has a structure in which these components are laminated in order. In the fluid pump 901, the piezoelectric device 32 and the diaphragm 31 joined to the piezoelectric device 32 constitute an actuator 30.

An end portion of the diaphragm 31 is adhesively fixed via the spacer 37 to an end portion of the flexible plate 35 having an air hole 35A formed at its center. Thus, the diaphragm 31 is supported by the spacer 37 so as to be spaced apart from the flexible plate 35 by the thickness of the spacer 37.

In addition, the base plate 39 having an opening 40 formed at its center is joined to the flexible plate 35. A portion of the flexible plate 35 that covers the opening 40 is able to vibrate with substantially the same frequency as that of the actuator 30 by variation in the pressure of a fluid associated with vibration of the actuator 30.

That is, due to the configuration of the flexible plate 35 and the base plate 39, the portion of the flexible plate 35 that covers the opening 40 becomes a movable portion 41 that is able to flexurally vibrate, and an outer side portion of the flexible plate 35 with respect to the movable portion 41 becomes a fixed portion 42 that is restrained by the base plate 39. It should be noted that the movable portion 41 includes the center of a region of the flexible plate 35 that faces the actuator 30.

In addition, the cover plate 95 is joined to a lower portion of the base plate 39, and an air hole 97 is provided in the cover plate 95 and communicates with the opening 40.

In the above structure, when a drive voltage is applied to the piezoelectric device 32, the diaphragm 31 flexurally vibrates due to expansion and contraction of the piezoelectric device 32, and the movable portion 41 of the flexible plate 35 vibrates with the vibration of the diaphragm 31, in the fluid pump 901. Thus, the fluid pump 901 sucks or discharges air through the air hole 97.

Accordingly, in the fluid pump 901, since the movable portion 41 of the flexible plate 35 vibrates with the vibration of the actuator 30, it is possible to substantially increase the vibration amplitude. Thus, the fluid pump 901 is able to obtain a high discharge pressure (hereinafter, referred to as "pump pressure") and a high flow rate even though the fluid pump 901 is small in size and low in height.

Here, the natural vibration frequency of the flexible plate 35 is determined by the diameter of the movable portion 41, the thickness of the movable portion 41, the material of the movable portion 41, the tensile stress of the movable portion 41, and the like. As the natural vibration frequency of the flexible plate 35 is closer to the drive frequency of the drive voltage applied to the fluid pump 901, the movable portion 41 of the flexible plate 35 vibrates more with the vibration of the actuator 30.

However, the shape of each component constituting the fluid pump 901 is varied for each fluid pump 901, and there is a limit on the accuracy of positioning when each component is laminated. Thus, the natural vibration frequency of the flexible plate 35 is varied for each fluid pump 901.

Therefore, it is difficult to closely adjust the natural vibration frequency of the flexible plate 35 in the fluid pump 901 to an optimum value at which a desired pump pressure equal to or higher than a predetermined value is obtained with power consumption within an allowable range.

SUMMARY OF THE INVENTION

Therefore, preferred embodiments of the present invention provide a fluid control apparatus that allows the natural vibration frequency of a flexible plate to be adjusted to an optimum value, and a method for adjusting the fluid control apparatus.

A fluid control apparatus according to a preferred embodiment of the present invention includes a diaphragm unit including a diaphragm and a frame plate surrounding a periphery of the diaphragm; a driver, arranged on a principal surface of the diaphragm to vibrate the diaphragm; a flexible plate including a hole and joined to the frame plate so as to face another principal surface of the diaphragm; and a cover member joined to a principal surface of the flexible plate on a side opposite to the diaphragm. Tensile stress is added to the flexible plate by the cover member.

In this configuration, by pressing the principal surface of the cover member on the side opposite to the diaphragm, the cover member is deformed and warps convexly toward the diaphragm side. Accordingly, a portion of the flexible plate that is joined to the cover member is pulled. Thus, tensile stress is added to the flexible plate, and the tensile stress of the flexible plate is increased.

Thus, according to this configuration, the warp amount of the cover member is changed by pressing the cover member. As a result, it is possible to adjust the natural vibration frequency of the flexible plate, which vibrates with vibration of the diaphragm, to an optimum value at which a desired discharge pressure equal to or higher than a predetermined value is obtained with power consumption within an allowable range. Therefore, according to this configuration, it is possible to increase the discharge pressure while significantly decreasing power consumption.

Preferably, the cover member includes a recess at a center or approximate center thereof, and the flexible plate includes a movable portion that faces the recess of the cover member and is able to flexurally vibrate and a fixed portion that is joined to the cover member.

In this configuration, since the movable portion vibrates with vibration of the actuator, it is possible to significantly increase the vibration amplitude. Thus, it is possible to increase the pressure and the flow rate.

Preferably, the cover member is a joined body including a base plate that is joined at one principal surface thereof to the principal surface of the flexible plate on the side opposite to the diaphragm and includes an opening at a center or approximate center thereof; and a cover plate that is provided on another principal surface of the base plate.

In this configuration, by pressing the principal surface of the cover plate on the side opposite to the diaphragm, the warp amount of the cover member is changed, and tensile stress is added to the flexible plate. In this manner, it is possible to adjust the natural vibration frequency of the flexible plate to the optimum value.

Preferably, a center portion of the cover plate corresponding to a surface on a back side of the recess is pressed toward the diaphragm side.

In this configuration, by pressing the center portion of the principal surface of the cover plate on the side opposite to the diaphragm, the warp amount of the cover member is changed, and tensile stress is added to the flexible plate. In this manner, it is possible to adjust the natural vibration frequency of the flexible plate to the optimum value.

Preferably, the cover plate includes an indentation on the center portion.

In this configuration, by pressing the center portion of the principal surface of the cover plate on the side opposite to the diaphragm, the indentation remains on the cover plate. Accordingly, the portion of the flexible plate that is joined to the cover member is pulled, and thus residual tensile stress is added to the flexible plate and the same advantageous effect as described above is obtained.

Preferably, the fluid control apparatus further includes an outer housing, and the cover member defines a portion of the outer housing.

In this configuration, it is easy to press the cover member from the outside.

Preferably, the cover member preferably includes a ductile metallic material.

In this configuration, it is possible to plastically deform the cover member with a lower load.

Preferably, the diaphragm unit further includes a connection portion that connects the diaphragm and the frame plate and elastically supports the diaphragm with respect to the frame plate.

In this configuration, since the diaphragm is flexibly and elastically supported by the connection portion with respect to the frame plate, flexural vibration of the diaphragm by expansion and contraction of the piezoelectric device is not impeded or substantially not impeded. Thus, loss associated with the flexural vibration of the diaphragm is reduced.

Preferably, the diaphragm and the driver constitute an actuator, and the actuator is disc-shaped.

In this configuration, the actuator vibrates in a rotationally-symmetrical manner (in a concentric manner). Thus, an unnecessary gap does not occur between the actuator and the flexible plate, and the operating efficiency as a pump is increased.

In addition, a method for adjusting a fluid control apparatus according to yet another preferred embodiment of the present invention includes the steps of measuring a discharge pressure of a fluid discharged from the fluid control apparatus according to any one of the above-described preferred embodiments of the present invention by vibration of the diaphragm, and inspecting whether the discharge pressure is equal to or higher than a predetermined value; and pressing the principal surface of the cover member on the side opposite to the diaphragm when the discharge pressure is less than the predetermined value. The pressing step further includes the step of returning to the inspecting step after the pressing step.

In this method, the inspecting step is conducted for a manufactured fluid control apparatus. Here, when the discharge pressure is equal to or higher than the predetermined value, the fluid control apparatus is not required to be adjusted in natural vibration frequency, and it is possible to determine the fluid control apparatus as being non-defective.

On the other hand, when the discharge pressure is less than the predetermined value, the pressing step of pressing the principal surface of the cover member on the side opposite to the diaphragm is conducted. By so doing, the cover member is shaped so as to warp convexly toward the diaphragm side. Accordingly, the flexible plate is pulled at its portion joined to the cover member and warps convexly toward the diaphragm side. Thus, residual tensile stress is added to the flexible plate, and the tensile stress of the flexible plate is increased.

Then, the fluid control apparatus for which the pressing step has been conducted is re-inspected in the inspecting step as to whether the discharge pressure is equal to or higher than the predetermined value. Here, when the discharge pressure is equal to or higher than the predetermined value, this means that the flexible plate of the fluid control apparatus is adjusted to have an optimum natural vibration frequency by the pressing step, and it is possible to determine the fluid control apparatus as being non-defective.

On the other hand, for the fluid control apparatus whose discharge pressure is still less than the predetermined value even in the re-inspection, the pressing step is conducted again. Then, similarly, the inspecting step and the pressing step are repeated.

Due to the above, according to this method, it is possible to adjust the natural vibration frequency of the flexible plate to an optimum value at which a desired discharge pressure equal to or higher than the predetermined value is obtained with power consumption within an allowable range. Therefore, according to this method, it is possible to provide a fluid control apparatus whose discharge pressure is increased while power consumption is significantly reduced.

The pressing step preferably further includes the step of increasing a pressure to press the cover member each time the number of times the cover member is pressed is increased.

In this method, since the pressure to press the cover member is increased in the pressing step each time the inspecting step and the pressing step are repeated, it is possible to reliably deform the cover member to a degree corresponding to the pressing pressure.

The inspecting step preferably applies a drive voltage obtained by superimposing a DC bias voltage on an AC voltage, to the driver, increases an interval from the diaphragm to the flexible plate from that when the drive voltage is not applied to the driver, vibrates the diaphragm, and measures the discharge pressure.

When the drive voltage is applied to the driver, the interval from the diaphragm to the flexible plate is increased by the effect of the DC bias voltage. Here, the interval is an important factor that influences the discharge pressure-discharge flow rate characteristics of the fluid control apparatus. Thus, when the interval is increased, the discharge pressure of the fluid control apparatus is decreased.

Meanwhile, the tensile stress of the flexible plate decreases with increases in the temperature of the fluid control apparatus, and the natural vibration frequency also decreases with decreases in the tensile stress of the flexible plate. In other words, the discharge pressure of the fluid control apparatus decreases with increases in the temperature of the fluid control apparatus.

Thus, when the interval from the diaphragm to the flexible plate is increased, the discharge pressure of the fluid control apparatus exhibits a value close to the discharge pressure of the fluid control apparatus at a temperature higher than normal temperature.

Therefore, in measuring a discharge pressure at a temperature higher than normal temperature is measured, it is necessary to measure the pump pressure of the fluid control apparatus after the fluid control apparatus is driven for a long time period and the temperature of the fluid control apparatus is increased by generated heat. However, in this method, by applying the drive voltage to the driver, it is possible to measure, in a pseudo manner, a discharge pressure at a temperature higher than normal temperature. Thus, it is possible to conduct the inspecting step in a short time.

According to various preferred embodiments of the present invention, it is possible to adjust the natural vibration frequency of the flexible plate to an optimum value at which a desired discharge pressure equal to or higher than the predetermined value is obtained with power consumption within an allowable range.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a piezoelectric pump 101 according to preferred embodiments of the present invention will be described.

Figure 1:
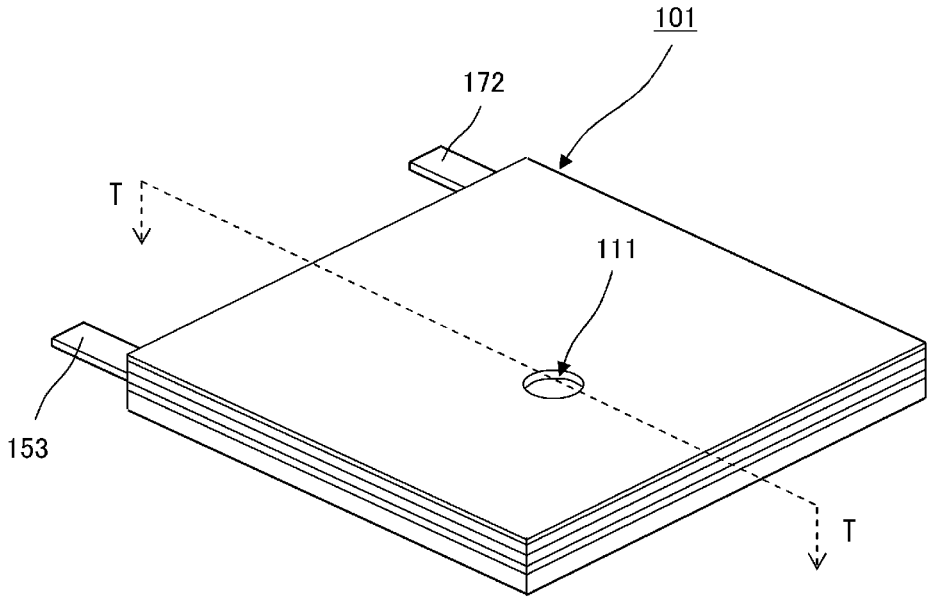
FIG. 1 is an external perspective view of a piezoelectric pump 101 according to a preferred embodiment of the present invention.
Figure 2:
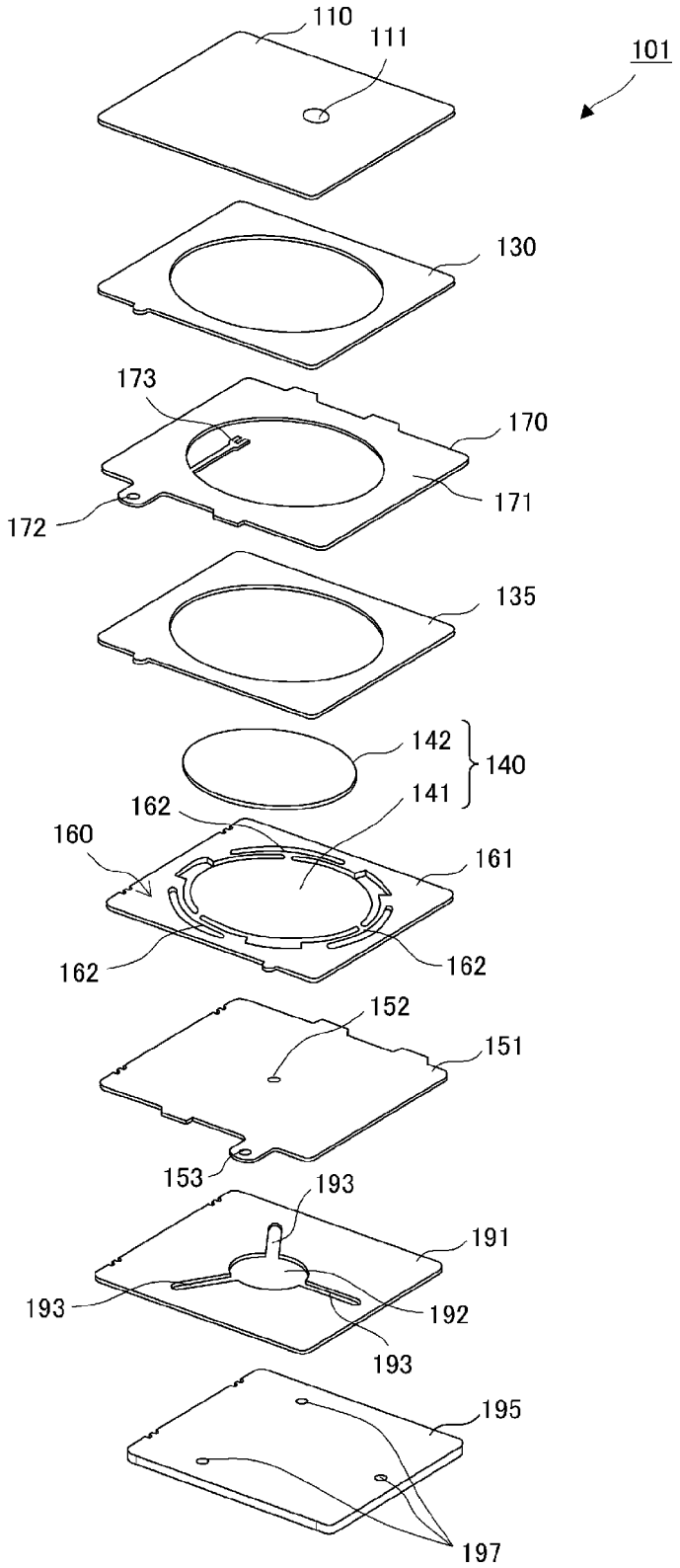
FIG. 2 is an exploded perspective view of the piezoelectric pump 101 shown in FIG. 1.
Figure 3:
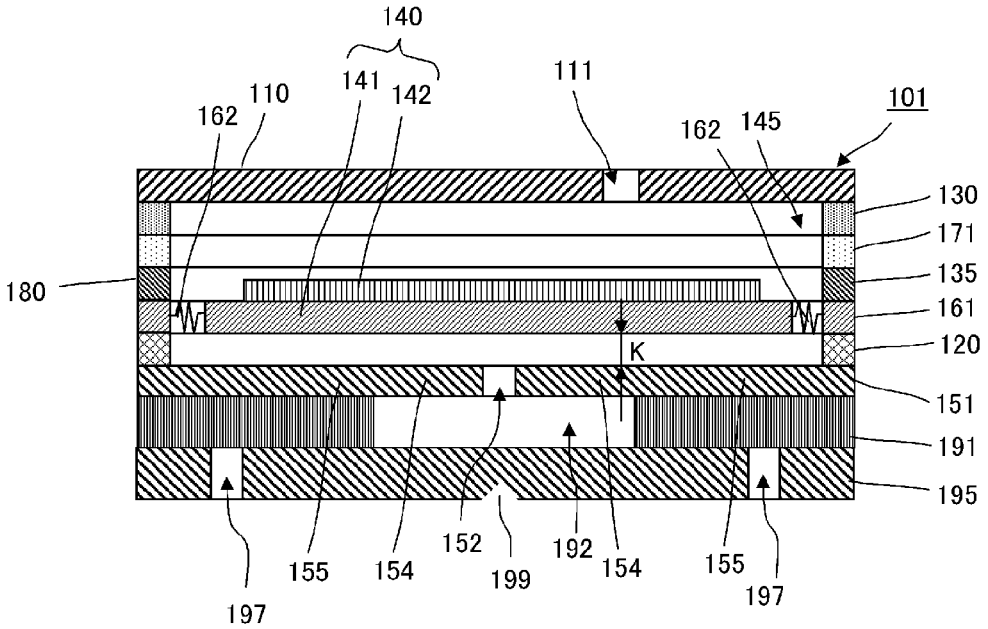
FIG. 3 is a cross-sectional view of the piezoelectric pump 101 shown in FIG. 1, taken along a line T-T.

FIG. 1 is an external perspective view of the piezoelectric pump 101 according to a preferred embodiment of the present invention. FIG. 2 is an exploded perspective view of the piezoelectric pump 101 shown in FIG. 1, and FIG. 3 is a cross-sectional view of the piezoelectric pump 101 shown in FIG. 1, taken along a line T-T.

As shown in FIG. 2, the piezoelectric pump 101 includes a cover plate 195, a base plate 191, a flexible plate 151, a diaphragm unit 160, a piezoelectric device 142, a spacer 135, an electrode conducting plate 170, a spacer 130, and a cover portion 110, and has a structure in which these components are laminated in order.

A diaphragm 141 includes an upper surface on which the piezoelectric device 142 is provided and a lower surface that faces the flexible plate 151. The piezoelectric device 142 is adhesively fixed to the upper surface of the disc-shaped diaphragm 141, and the diaphragm 141 and the piezoelectric device 142 constitute a disc-shaped actuator 140. Here, the diaphragm unit 160 including the diaphragm 141 preferably is made of a metallic material having a higher coefficient of linear expansion than the coefficient of linear expansion of the piezoelectric device 142.

Thus, when the diaphragm 141 and the piezoelectric device 142 are heated and cured in bonding the diaphragm 141 and the piezoelectric device 142, it is possible to cause appropriate compressive stress to remain in the piezoelectric device 142 while the diaphragm 141 warps convexly toward the piezoelectric device 142 side, and thus it is possible to prevent the piezoelectric device 142 from being fractured. For example, the diaphragm unit 160 is preferably made of SUS430 or other suitable material, for example. For example, the piezoelectric device 142 is preferably made of a PZT ceramic or other suitable material, for example. The coefficient of linear expansion of the piezoelectric device 142 is substantially zero, and the coefficient of linear expansion of SUS430 is about $10.4\times10^{-6}$ $K^{-1}$.

It should be noted that the piezoelectric device 142 corresponds to "a driver".

The thickness of the spacer 135 is preferably equal to or slightly larger than the thickness of the piezoelectric device 142.

The diaphragm unit 160 preferably includes the diaphragm 141, a frame plate 161, and connection portions 162. The diaphragm unit 160 is formed preferably through integral formation by etching or molding a metal plate, for example. The frame plate 161 is provided around the diaphragm 141, and the diaphragm 141 is connected to the frame plate 161 via the connection portions 162. The frame plate 161 is adhesively fixed to the flexible plate 151 via an adhesive layer 120 containing a plurality of spherical fine particles.

Here, the material of the adhesive of the adhesive layer 120 is, for example, a thermosetting resin such as an epoxy resin, and the material of the fine particles is, for example, resin or silica coated with a conductive metal. In bonding, the adhesive layer 120 is cured by being heated under a pressing condition. Thus, after bonding, the frame plate 161 and the flexible plate 151 are adhesively fixed to each other by the adhesive layer 120 in a state of sandwiching the plurality of fine particles.

That is, the diaphragm 141 and the connection portions 162 are arranged such that the surfaces of the diaphragm 141 and the connection portions 162 on the flexible plate 151 side are spaced apart from the flexible plate 151 by the diameter of each fine particle. Thus, it is possible to define the distance between the diaphragm 141 and the connection portions 162; and the flexible plate 151 by the diameter (e.g., about 15 μm) of each fine particle. In addition, the connection portions 162 have an elastic structure having a low spring constant.

Therefore, the diaphragm 141 is flexibly and elastically supported by the three connection portions 162 at three points with respect to the frame plate 161, and flexural vibration of the diaphragm 141 is not impeded or substantially not impeded. In other words, the piezoelectric pump 101 has a structure in which a peripheral portion of the actuator 140 (of course, also a central portion thereof) is not restrained or not substantially restrained. Thus, in the piezoelectric pump 101, loss associated with vibration of the diaphragm 141 is low, and a high pressure and a high flow rate are obtained even though the piezoelectric pump 101 is small in size and low in height.

The spacer 135 made of resin is adhesively fixed to the upper surface of the frame plate 161. The thickness of the spacer 135 is equal to or slightly larger than that of the piezoelectric device 142, defines a portion of a pump housing 180, and electrically insulates the next-described electrode conducting plate 170 and the diaphragm unit 160 from each other.

The electrode conducting plate 170 made of metal is adhesively fixed on the spacer 135. The electrode conducting plate 170 preferably includes a frame portion 171 having a circular or substantially circular opening, an internal terminal 173 projecting in the opening, and an external terminal 172 projecting externally.

An end of the internal terminal 173 is soldered to a surface of the piezoelectric device 142. By setting the soldered position at a position corresponding to the node of the flexural vibration of the actuator 140, it is possible to significantly reduce or prevent vibration of the internal terminal 173.

The spacer 130 made of resin is adhesively fixed on the electrode conducting plate 170. The spacer 130 has a thickness substantially equal to that of the piezoelectric device 142. The spacer 130 is a spacer that prevents the soldered portion of the internal terminal 173 from coming into contact with the cover portion 110 when the actuator vibrates. In addition, the spacer 130 significantly reduces or prevents a decrease in the vibration amplitude by air resistance due to the surface of the piezoelectric device 142 being excessively close to the cover portion 110. Thus, the thickness of the spacer 130 is preferably substantially equal to the thickness of the piezoelectric device 142 as described above.

The cover portion 110 is joined to an upper end portion of the spacer 130 and covers an upper portion of the actuator 140. Thus, a fluid that is sucked through an air hole 152 of the later-described flexible plate 151 is discharged through a discharge hole 111. The discharge hole 111 is provided at the center of the cover portion 110. However, since the discharge hole 111 is a discharge hole that releases a positive pressure within the pump housing 180 including the cover portion 110, the discharge hole 111 does not necessarily need to be provided at the center of the cover portion 110.

An external terminal 153 for electrical connection is provided in the flexible plate 151. In addition, the air hole 152 is provided at the center of the flexible plate 151. The flexible plate 151 faces the diaphragm 141 and is adhesively fixed to the frame plate 161 across the plurality of fine particles by the adhesive layer 120.

Thus, in the piezoelectric pump 101 of the present preferred embodiment, when the frame plate 161 and the flexible plate 151 are adhesively fixed to each other via the adhesive layer 120, the thickness of the adhesive layer 120 is not smaller than the diameter of each fine particle, and thus it is possible to reduce an amount of the adhesive of the adhesive layer 120 that flows out.

In addition, in the piezoelectric pump 101, even when an excess amount of the adhesive flows into the gap between the connection portion 162 and the flexible plate 151, since the surface of the connection portion 162 on the flexible plate 151 side is spaced apart from the flexible plate 151 by the diameter of each fine particle, it is possible to significantly reduce or prevent bonding the connection portion 162 and the flexible plate 151 to each other. Similarly, even when an excess amount of the adhesive flows into the gap between the diaphragm 141 and the flexible plate 151, since the surface of the diaphragm 141 on the flexible plate 151 side is spaced apart from the flexible plate 151 by the diameter of each fine particle, it is possible to significantly reduce or prevent bonding the diaphragm 141 and the flexible plate 151 to each other.

Thus, in the piezoelectric pump 101 of the preferred embodiment, it is possible to significantly reduce or prevent the diaphragm 141 and the connection portion 162 being bonded to the flexible plate 151 by an excess amount of the adhesive to impede vibration of the diaphragm 141.

The base plate 191 that includes an opening 192 at its center or approximate center and having a circular or substantially circular shape in a planar view is joined to a lower portion of the flexible plate 151. A portion of the flexible plate 151 that covers the opening 192 is able to vibrate with substantially the same frequency as that of the actuator 140 by variation in the pressure of air associated with vibration of the actuator 140.

That is, due to the configuration of the flexible plate 151 and the base plate 191, the portion of the flexible plate 151 that covers the opening 192 becomes a movable portion 154 that is able to flexurally vibrate, and an outer side portion of the flexible plate 151 with respect to the movable portion 154 becomes a fixed portion 155 that is restrained by the base plate 191. It should be noted that the movable portion 154 includes the center of a region of the flexible plate 151 that faces the actuator 140. A design is such that the natural vibration frequency of the circular movable portion 154 is equal to or slightly lower than the drive frequency of the actuator 140.

Therefore, the movable portion 154 of the flexible plate 151 including the air hole 152 at its center also vibrates at great amplitude in response to vibration of the actuator 140. When the flexible plate 151 vibrates such that the vibration phase thereof is later than the vibration phase of the actuator 140 (e.g. by 90° behind), variation in the thickness of the gap space between the flexible plate 151 and the actuator 140 is substantially increased. Thus, it is possible to further improve the capability of the pump.

The cover plate 195 is joined to a lower portion of the base plate 191. Three suction holes 197, for example, are provided in the cover plate 195. The suction holes 197 communicate with the opening 192 via flow paths 193 provided in the base plate 191. A joined body of the base plate 191 and the cover plate 195 corresponds to "a cover member" and defines a portion of the pump housing 180. The joined body has a shape in which a recess is defined at its center or approximate center by the opening 192.

It should be noted that an indentation 199 located at the center or approximate center of a principal surface of the cover plate 195 on a side opposite to the diaphragm 141 will be described in detail later.

Each of the flexible plate 151, the base plate 191, and the cover plate 195 is formed from a material having a higher coefficient of linear expansion than the coefficient of linear expansion of the diaphragm unit 160. The flexible plate 151, the base plate 191, and the cover plate 195 are preferably made from materials whose coefficients of linear expansion are substantially the same. For example, the flexible plate 151 is preferably made of beryllium copper, the base plate 191 is preferably made of phosphor bronze, and the cover plate 195 is preferably made of copper or other suitable material. The coefficients of linear expansion of these materials are about $17\times10^{-6}$ $K^{-1}$. In addition, the diaphragm unit 160 is preferably made of, for example, SUS430 or other suitable material. The coefficient of linear expansion of SUS430 is about $10.4\times10^{-6}$ $K^{-1}$.

In this case, since the coefficients of linear expansion of the flexible plate 151, the base plate 191, and the cover plate 195 are different from that of the frame plate 161, when heating and curing are conducted in bonding, appropriate tensile stress is provided to the movable portion 154 that is located around the center and is able to flexurally vibrate, while the flexible plate 151 warps convexly toward the piezoelectric device 142 side.

Thus, the tensile stress of the movable portion 154 that is able to flexurally vibrate is appropriately adjusted, and the movable portion 154 that is able to flexurally vibrate does not sag to impede vibration of the movable portion 154. Beryllium copper defining the flexible plate 151 is a spring material. Thus, even when the circular movable portion 154 vibrates at great amplitude, fatigue or the like does not occur, and the durability is excellent.

In addition, the actuator 140 and the flexible plate 151 warp convexly toward the piezoelectric device 142 side at normal temperature by substantially equal amounts. Here, the actuator 140 and the flexible plate 151 less wrap due to temperature increase by heat generated when the piezoelectric pump 101 is driven or due to increase in the environmental temperature, but the warp amounts of the actuator 140 and the flexible plate 151 are substantially equal to each other at the same temperature.

That is, the distance between the diaphragm 141 and the flexible plate 151 defined by the diameter of each fine particle does not change due to the temperature. Thus, in the piezoelectric pump 101 of the present preferred embodiment, it is possible to maintain appropriate pressure-flow rate characteristics of the pump over a wide temperature range.

In the above structure, when an AC drive voltage is applied to the external terminals 153 and 172, the actuator 140 flexurally vibrates in a concentric manner and the movable portion 154 of the flexible plate 151 vibrates with the vibration of the diaphragm 141 in the piezoelectric pump 101. By so doing, the piezoelectric pump 101 sucks air through the suction holes 197 and the air hole 152 into a pump chamber 145 and discharges the air in the pump chamber 145 through the discharge hole 111.

At that time, in the piezoelectric pump 101, since the movable portion 154 of the flexible plate 151 vibrates with the vibration of the actuator 140, it is possible to substantially increase the vibration amplitude, and the piezoelectric pump 101 is able to obtain a high discharge pressure (hereinafter, referred to as "pump pressure") and a high flow rate even though the piezoelectric pump 101 is small in size and low in height.

Here, the natural vibration frequency of the movable portion 154 is determined by the diameter of the movable portion 154, the thickness of the movable portion 154, the material of the movable portion 154, the above-described tensile stress of the movable portion 154, and the like. As the natural vibration frequency of the movable portion 154 of the flexible plate 151 is closer to the drive frequency of the drive voltage applied to the piezoelectric pump 101, the movable portion 154 vibrates more with the vibration of the actuator 140.

However, the tensile stress of the movable portion 154 decreases with increase in the temperature of the piezoelectric pump 101. Describing in detail, in the piezoelectric pump 101 of the present preferred embodiment, the piezoelectric device 142, the diaphragm unit 160, the flexible plate 151, the base plate 191, and the cover plate 195 are joined at a temperature (e.g., about 120° C.) higher than normal temperature (e.g., about 20° C.) (see FIG. 3).

Thus, after joining, at normal temperature, the diaphragm 141 warps convexly toward the piezoelectric device 142 side due to the above-described difference in coefficient of linear expansion between the diaphragm unit 160 and the piezoelectric device 142, and the flexible plate 151 warps convexly toward the piezoelectric device 142 side due to the above-described difference in coefficient of linear expansion between the diaphragm unit 160 and the base plate 191.

When the temperature of the piezoelectric pump 101 increases due to heat generated when the piezoelectric pump 101 is driven or due to change in the environmental temperature, the diaphragm 141 and the flexible plate 151 warp less. Thus, the tensile stress of the flexible plate 151 decreases with the increase in the temperature of the piezoelectric pump 101, and the natural vibration frequency of the flexible plate 151 also decreases with the decrease in the tensile stress of the flexible plate 151. In other words, the discharge pressure of the piezoelectric pump 101 decreases with the increase in the temperature of the piezoelectric pump 101.

Figure 8:
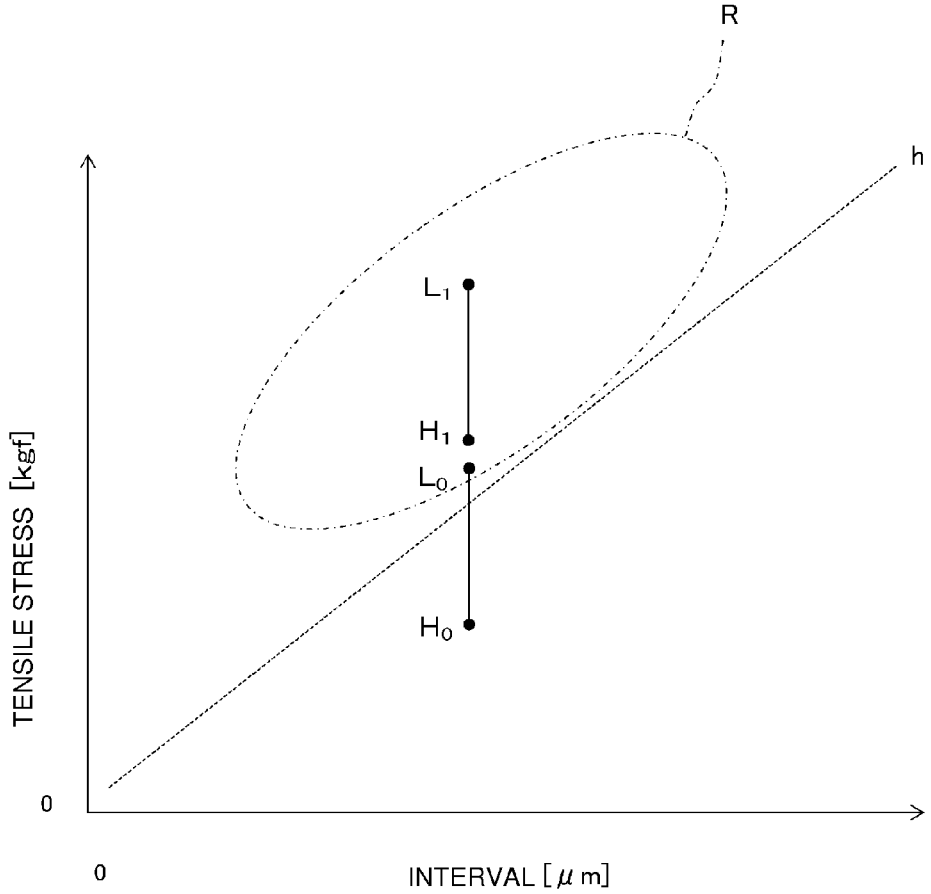
FIG. 8 is a graph showing a relationship between tensile stress of a flexible plate 151 and the interval (distance) between a piezoelectric actuator 140 and the flexible plate 151 in the first adjusting method.

FIG. 8 is a graph showing characteristics of the piezoelectric pump 101. In FIG. 8, the vertical axis indicates the tensile stress of the flexible plate 151, and the horizontal axis indicates the interval between the piezoelectric actuator 140 and the flexible plate 151.

In the piezoelectric pump 101, a border line h appears at which the pump pressure rapidly decreases when the tensile stress of the flexible plate 151 decreases, for example, when the piezoelectric pump 101 shifts from a first operating point $L_0$ to a second operating point $H_0$. The border line h at which the pump pressure rapidly decreases is referred to as separation line.

In order to avoid the rapid decrease in the pump pressure, for the piezoelectric pump 101, the operating point of the piezoelectric pump 101 is required to be above the separation line h even when the temperature of the piezoelectric pump 101 increases to the upper limit of a temperature range (e.g., about 10° C. to about 55° C.) that is assumed during actual use. On the other hand, it is not preferred that the tensile stress of the flexible plate 151 is greater than that on the separation line h by a larger amount, and if the tensile stress of the flexible plate 151 is too great, the power consumption is increased.

Therefore, in manufacturing the piezoelectric pump 101, it is necessary to adjust the natural vibration frequency of the movable portion 154 of the flexible plate 151 such that all operating points of the piezoelectric pump 101 within the above temperature range (e.g., about 10° C. to about 55° C.) fall within a non-defective range R (see FIG. 8) in which a desired pump pressure equal to or higher than a predetermined value is obtained with power consumption within an allowable range.

Thus, in the present preferred embodiment, a first adjusting method and a second adjusting method will be described as a method for adjusting the natural vibration frequency.

First, a first adjusting method for adjusting the natural vibration frequency of the movable portion 154 of the flexible plate 151 according to the present preferred embodiment to an optimum value at which a desired pump pressure equal to or higher than a predetermined value is obtained with power consumption within an allowable range, will be described below.

Figure 4:
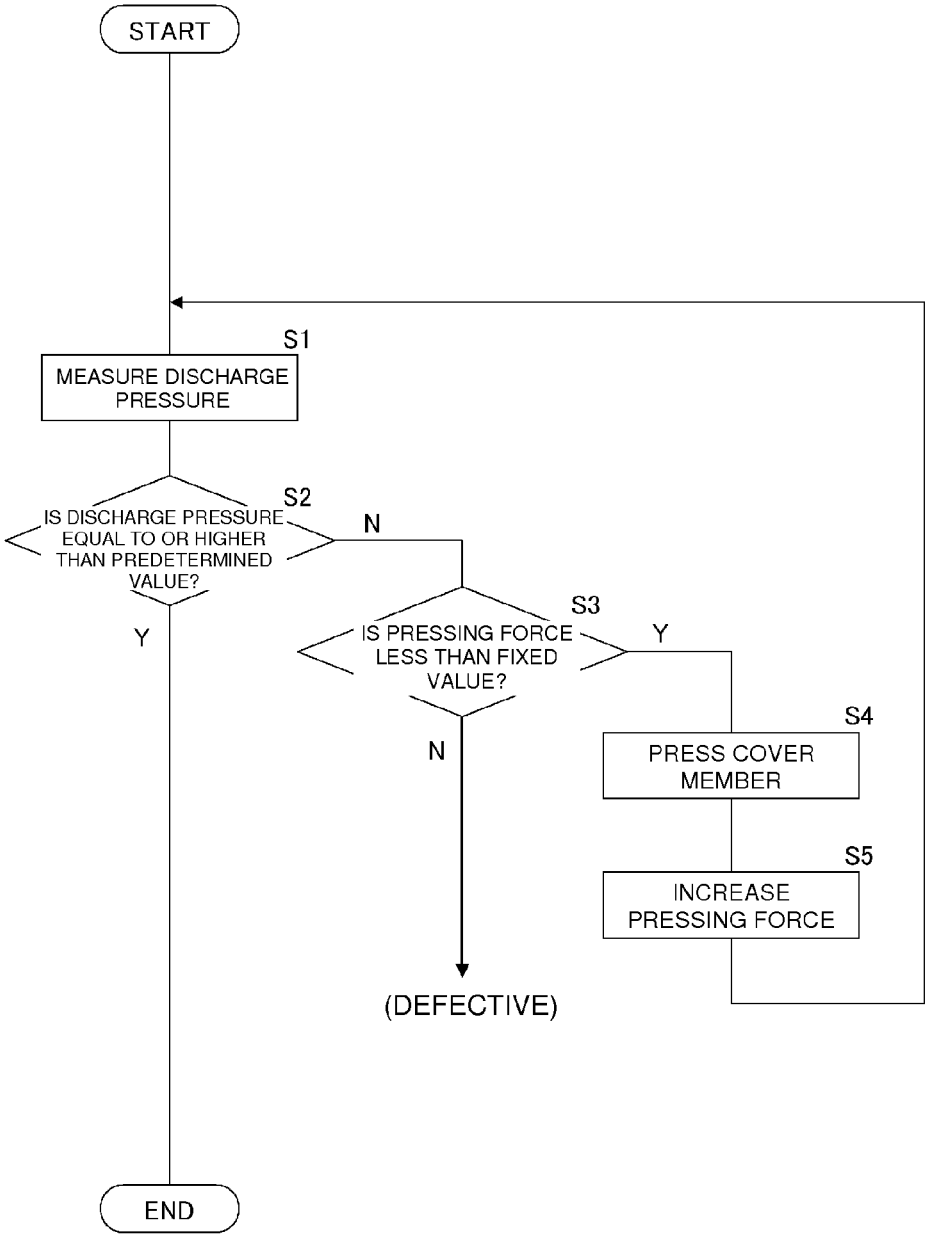
FIG. 4 is a flowchart showing a first adjusting method for the piezoelectric pump 101 according to a preferred embodiment of the present invention.
Figure 5:
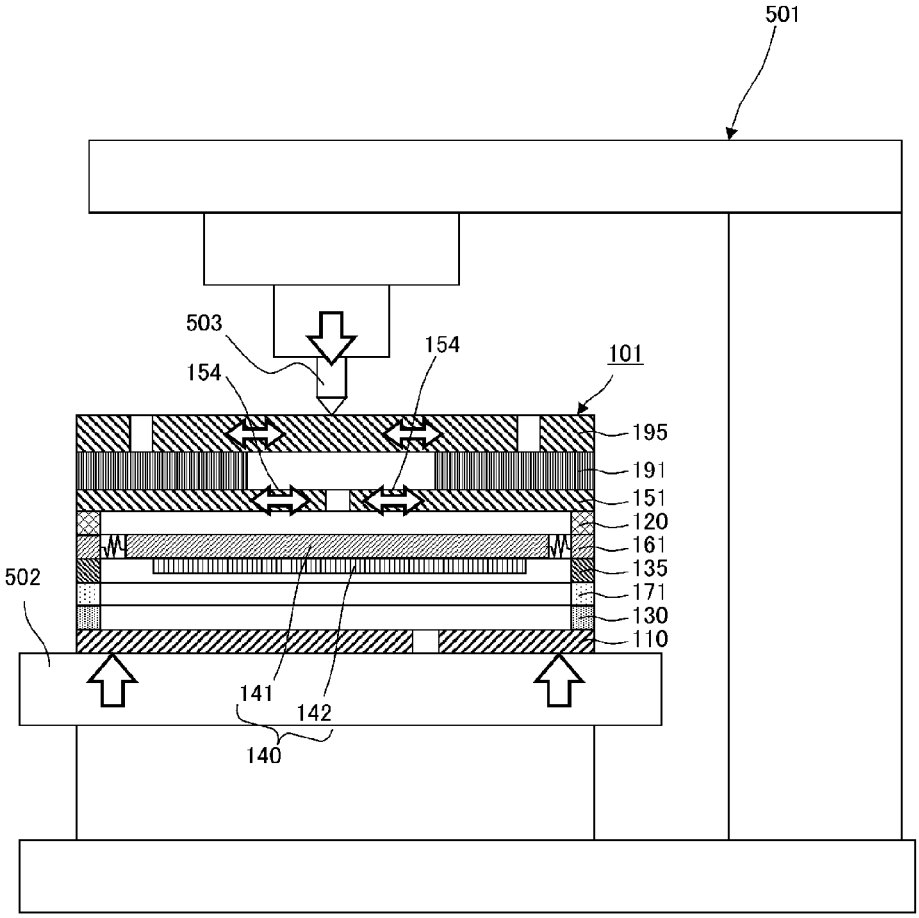
FIG. 5 is a cross-sectional view of the piezoelectric pump 101 placed on a cover pressing jig 501 when a cover plate 195 is pressed.
Figure 6:
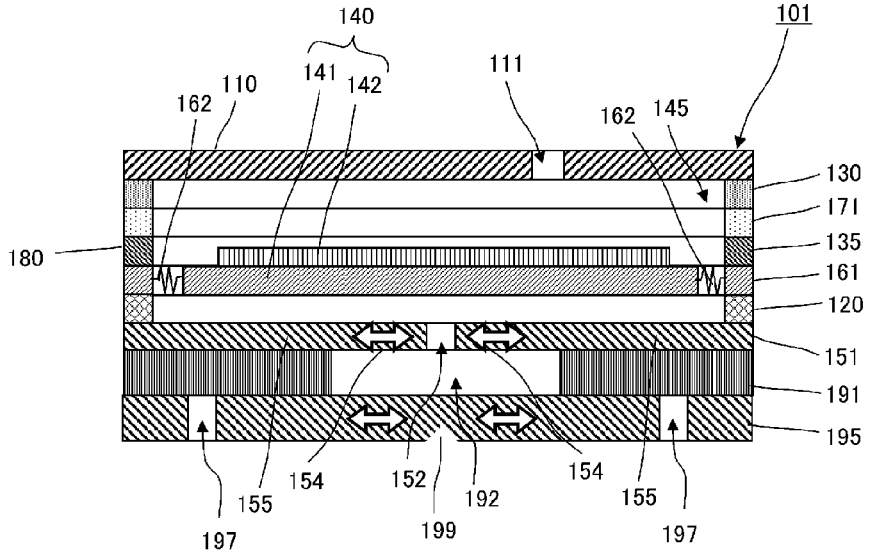
FIG. 6 is a cross-sectional view of the piezoelectric pump 101 after the cover plate 195 is pressed by the cover pressing jig 501.
Figure 7:
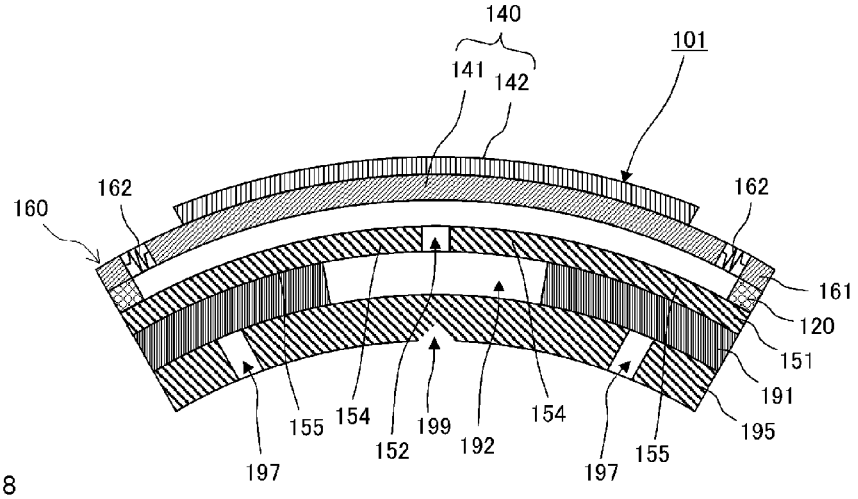
FIG. 7 is a cross-sectional view of a principal portion of the piezoelectric pump 101 after the cover plate 195 is pressed by the cover pressing jig 501.

FIG. 4 is a flowchart showing the first adjusting method for the piezoelectric pump 101 according to a preferred embodiment of the present invention. FIG. 5 is a cross-sectional view of the piezoelectric pump 101 placed on a cover pressing jig 501 when the cover plate 195 is pressed. FIG. 6 is a cross-sectional view of the piezoelectric pump 101 after the cover plate 195 is pressed by the cover pressing jig 501. FIG. 7 is a cross-sectional view of a principal portion of the piezoelectric pump 101 after the cover plate 195 is pressed by the cover pressing jig 501. Here, FIGS. 5 to 7 are cross-sectional views taken along a line T-T shown in FIG. 1. In addition, the cover pressing jig 501 shown in FIG. 5 is a jig that includes a stage 502 movable up or down and a pressing pin 503. Moreover, for explanation, FIG. 7 shows warp of a joined body of the diaphragm unit 160, the piezoelectric device 142, the flexible plate 151, the base plate 191, and the cover plate 195 in a more emphatic manner than the actual warp.

First, for a plurality of manufactured piezoelectric pumps 101, an inspecting step is conducted in which a pump pressure discharged from each piezoelectric pump 101 is measured and it is inspected whether the pump pressure is equal to or higher than a predetermined value (FIG. 4: S1 and S2). In the inspecting step, after the plurality of piezoelectric pumps 101 are driven for a long time period (for example, 300 seconds in the present preferred embodiment) in line with the actual usage environment and the temperatures of the plurality of piezoelectric pumps 101 are increased to nearly the upper limit of the above temperature range, the pump pressure of each piezoelectric pump 101 is measured. At that time, power consumption required to drive each piezoelectric pump 101 is also measured.

Here, the piezoelectric pump 101 whose pump pressure is equal to or higher than the predetermined value when the power consumption is within the allowable range is not required to be adjusted in natural vibration frequency and has the movable portion 154 having an optimum natural vibration frequency. Thus, such a piezoelectric pump 101 is determined as being non-defective without passing through a pressing step, and the adjustment of the piezoelectric pump 101 is ended. It should be noted that for the piezoelectric pump 101 determined as being non-defective, all items such as a pump pressure, a flow rate, and power consumption are measured with a characteristics screener, which is not shown, and further screening is conducted.

Meanwhile, when the temperatures of the plurality of piezoelectric pumps 101 are increased to nearly the upper limit of the temperature range, the piezoelectric pumps 101 are observed in which the operating point shifts from the first operating point $L_0$ to the second operating point $H_0$ below the separation line h and the pump pressure is decreased to be less than the predetermined value, for example, as shown in FIG. 8.

For the piezoelectric pump 101 whose pump pressure is less than the predetermined value, when the currently-set pressing force of the cover pressing jig 501 is less than a fixed value (for example, about 7 kgf in the present preferred embodiment), the piezoelectric pump 101 proceeds to a pressing step in S4 (FIG. 4: Y in S3).

In the pressing step, as shown in FIG. 5, the piezoelectric pump 101 is placed on the stage 502 with the cover plate 195 facing upward, the stage 502 is moved up, and the center portion of the principal surface of the cover plate 195 on the side opposite to the diaphragm 141 is pressed with the pressing pin 503 (FIG. 4: S4). In the pressing step, the pressing force of the cover pressing jig 501 is monitored with a load cell. It is possible to set the pressing force and the pressing time at any values by controlling a moving-up/down operation of the stage 502. In the present preferred embodiment, a pressing force set as an initial value is about 5 kgf, for example, and a pressing time set as an initial value is about 3 seconds, for example.

In the pressing step, after the pressing pin 503 presses the cover plate 195, the stage 502 is moved down, and the piezoelectric pump 101 is taken out from the cover pressing jig 501. As a result, an indentation 199 remains on the center portion of the cover plate 195, and the joined body of the cover plate 195 and the base plate 191 is shaped so as to warp convexly toward the diaphragm 141 side as shown in FIG. 7, and the portion joined to the flexible plate 151 is pulled, such that the flexible plate 151 is caused to warp convexly toward the diaphragm 141 side. Thus, residual tensile stress occurs in the movable portion 154 of the flexible plate 151 (see FIG. 6).

Therefore, the tensile stress of the movable portion 154 of the flexible plate 151 is increased by the residual tensile stress, and it is possible to make the natural vibration frequency of the movable portion 154 close to the optimum value at which a desired pump pressure equal to or higher than the predetermined value is obtained with power consumption within the allowable range. For example, by the residual tensile stress, the operating point of the piezoelectric pump 101 shifts from the first operating point $L_0$ to a third operating point $L_1$ (see FIG. 8), and the natural vibration frequency of the movable portion 154 also increases by, for example, about 200 Hz.

It should be noted that the material of the cover plate 195 is preferably a ductile material which is easily plastically deformed with a low load, such as pure aluminum (A1050) or pure copper (C1100). In the present preferred embodiment, pure copper (C1100) is preferably used.

Next, the currently-set pressing force of the cover pressing jig 501 is increased each time the number of times the cover plate 195 is pressed is increased, and the processing returns to the inspecting step in S1 (FIG. 4: S5). In the present preferred embodiment, the pressing force of the cover pressing jig 501 is increased by about 0.5 kgf from the pressing force (e.g., about 5 kgf) set currently as the initial value to be about 5.5 kgf, for example. The pressing time is kept at 3 seconds which is the same as the initial pressing time, for example.

Then, the piezoelectric pump 101 that has passed through the pressing step in S4 is re-inspected in the inspecting step in which the pump pressure discharged from the piezoelectric pump 101 is measured and it is inspected whether the pump pressure is equal to or higher than the predetermined value (FIG. 4: S1 and S2). In this inspecting step as well, a plurality of piezoelectric pumps 101 are driven for a long time period (for example, 300 seconds in the present preferred embodiment) in line with the actual usage environment, the temperatures of the plurality of piezoelectric pumps 101 are increased to nearly the upper limit of the above temperature range by generated heat, and then the pump pressure of each piezoelectric pump 101 is measured.

Therefore, when the temperatures of the plurality of piezoelectric pumps 101 are increased to nearly the upper limit of the temperature range, for example, the operating point of the piezoelectric pump 101 shifts from the third operating point $L_1$ to a fourth operating point $H_1$ as shown in FIG. 8. Here, if the pump pressure is equal to or higher than the predetermined value, this means that the movable portion 154 of the piezoelectric pump 101 is adjusted to an optimum natural vibration frequency by the pressing step. For example, if the operating point of the piezoelectric pump 101 is the fourth operating point $H_1$ as shown in FIG. 8, this means that the movable portion 154 of the piezoelectric pump 101 is adjusted to an optimum natural vibration frequency by the pressing step. Then, such a piezoelectric pump 101 is determined as being non-defective, and the adjustment of the natural vibration frequency is ended.

It should be noted that for the piezoelectric pump 101 determined as being non-defective, all items such as a pump pressure, a flow rate, and power consumption are measured with a characteristics screener, which is not shown, and further screening is preferably conducted.

Meanwhile, for the piezoelectric pump 101 whose pump pressure is less than the predetermined value even when the piezoelectric pump 101 has passed through the pressing step, the pressing step is conducted again (FIG. 4: S4).

That is, thereafter, the inspecting step and the pressing step are repeated until the set pressing force of the cover pressing jig 501 becomes equal to or greater than the fixed value (for example, about 7 kgf in the present preferred embodiment) (FIG. 4: S3). In this case, the set pressing force of the cover pressing jig 501 is increased by about 0.5 kgf in the process in S5 in FIG. 4 each time the pressing step is conducted, for example.

Then, the piezoelectric pump 101 whose pump pressure is less than the predetermined value even when the pressing step and the inspecting step are repeated a plurality of times, or the piezoelectric pump 101 whose power consumption required for driving exceeds an allowable value, is determined as being defective and is discarded, when the currently-set pressing force of the cover pressing jig 501 becomes equal to or greater than the fixed value (FIG. 4: N in S3).

Due to the above, according to the first adjusting method of the present preferred embodiment, in consideration of increase in the temperature of the piezoelectric pump 101, it is possible to adjust the natural vibration frequency of the movable portion 154 to the optimum value at which a desired pump pressure equal to or higher than the predetermined value is obtained with power consumption within the allowable range. Therefore, according to the first adjusting method of the present preferred embodiment, it is possible to provide the piezoelectric pump 101 whose pump pressure is increased while power consumption is significantly reduced.

In addition, according to the piezoelectric pump 101 of the present preferred embodiment, by changing the warp amount of the joined body of the cover plate 195 and the base plate 191 by pressing the cover plate 195, it is possible to adjust the natural vibration frequency of the movable portion 154 to the optimum value at which a desired pump pressure equal to or higher than the predetermined value is obtained with power consumption within the allowable range. Therefore, according to the piezoelectric pump 101 of the present preferred embodiment, it is possible to increase the discharge pressure while significantly reducing the power consumption.

In addition, since the joined body of the base plate 191 and the cover plate 195 defines a portion of the pump housing 180, the piezoelectric pump 101 of the present preferred embodiment has a structure in which the cover plate 195 is easily pressed by the cover pressing jig 501.

It should be noted that as in the first adjusting method of the present preferred embodiment, by pressing the cover plate 195, it is possible to add tensile stress to the movable portion 154 of the flexible plate 151 and to increase the natural vibration frequency, but it is impossible to decrease the tensile stress and to decrease the natural vibration frequency.

Therefore, it is preferred that a design is made such that the natural vibration frequency of the movable portion 154 is slightly lower than the optimum value, and then the piezoelectric pump 101 is adjusted by the first adjusting method of the present preferred embodiment after the manufacture thereof. Thus, even when the natural vibration frequency of the movable portion 154 of the flexible plate 151 is varied for each piezoelectric pump 101 after the manufacture thereof, it is possible to accomplish a high non-defective rate.

Next, the second adjusting method for adjusting the natural vibration frequency of the movable portion 154 of the flexible plate 151 according to another preferred embodiment to an optimum value at which a desired pump pressure equal to or higher than a predetermined value is obtained with power consumption within an allowable range, will be described below. The second adjusting method is different from the first adjusting method in the inspecting step shown in S1 and S2 in FIG. 4. The second adjusting method is preferably the same or substantially the same in the other points as the first adjusting method.

Describing in detail, in the second adjusting method as well, first, for a plurality of manufactured piezoelectric pumps 101, an inspecting step is conducted in which the pump pressure discharged from each piezoelectric pump 101 is measured and it is inspected whether the pump pressure is equal to or higher than a predetermined value (FIG. 4: S1 and S2).

However, in the second adjusting method, in the inspecting step, a drive voltage obtained by superimposing a DC bias voltage on an AC voltage outputted from a commercial AC power supply is applied to the piezoelectric device 142 to vibrate the actuator 140, and the pump pressure of the piezoelectric pump 101 is measured. In this case, power consumption required for driving each piezoelectric pump 101 is also measured.

Here, when the drive voltage is applied to the external terminals 153 and 172, the actuator 140 warps convexly toward the piezoelectric device 142 side so as to be separated from the flexible plate 151 by the DC bias voltage in the piezoelectric pump 101, and an interval K (see FIG. 3) as the shortest distance between the actuator 140 and the flexible plate 151 is increased. Then, the actuator 140 flexurally vibrates in a concentric manner centered at the increased interval K, and the movable portion 154 of the flexible plate 151 vibrates with the vibration of the diaphragm 141.

For example, in the piezoelectric pump 101 of the present preferred embodiment, when a drive voltage obtained by superimposing a DC bias voltage of about 15V on an AC voltage of about 38 Vp-p having a frequency of about 23 kHz is applied to the external terminals 153 and 172, the interval K between the actuator 140 and the flexible plate 151 is increased by about 1 μm, the actuator 140 flexurally vibrates in a concentric manner centered at the interval K increased by about 1 μm, and the movable portion 154 of the flexible plate 151 vibrates with the vibration of the diaphragm 141, for example.

Here, the interval K between the actuator 140 and the flexible plate 151 is an important factor that influences the pressure-flow rate characteristics (hereinafter, referred to as PQ characteristics) of the pump. Thus, when the interval K is increased, the pump pressure of the piezoelectric pump 101 decreases. Therefore, when the interval K is increased, the pump pressure of the piezoelectric pump 101 exhibits a value close to the pump pressure of the piezoelectric pump 101 at a temperature higher than normal temperature.

Figure 9:
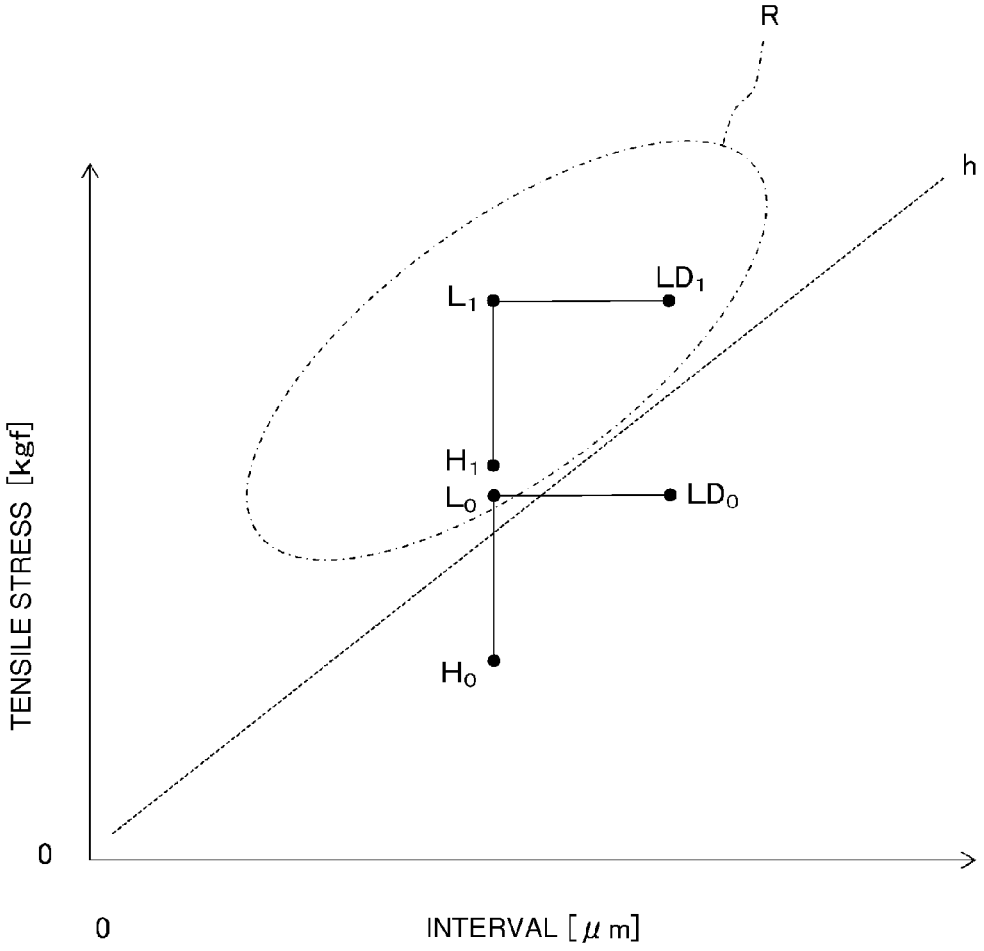
FIG. 9 is a graph showing a relationship between tensile stress of the flexible plate 151 and the interval (distance) between the piezoelectric actuator 140 and the flexible plate 151 in a second adjusting method.
Figure 10:
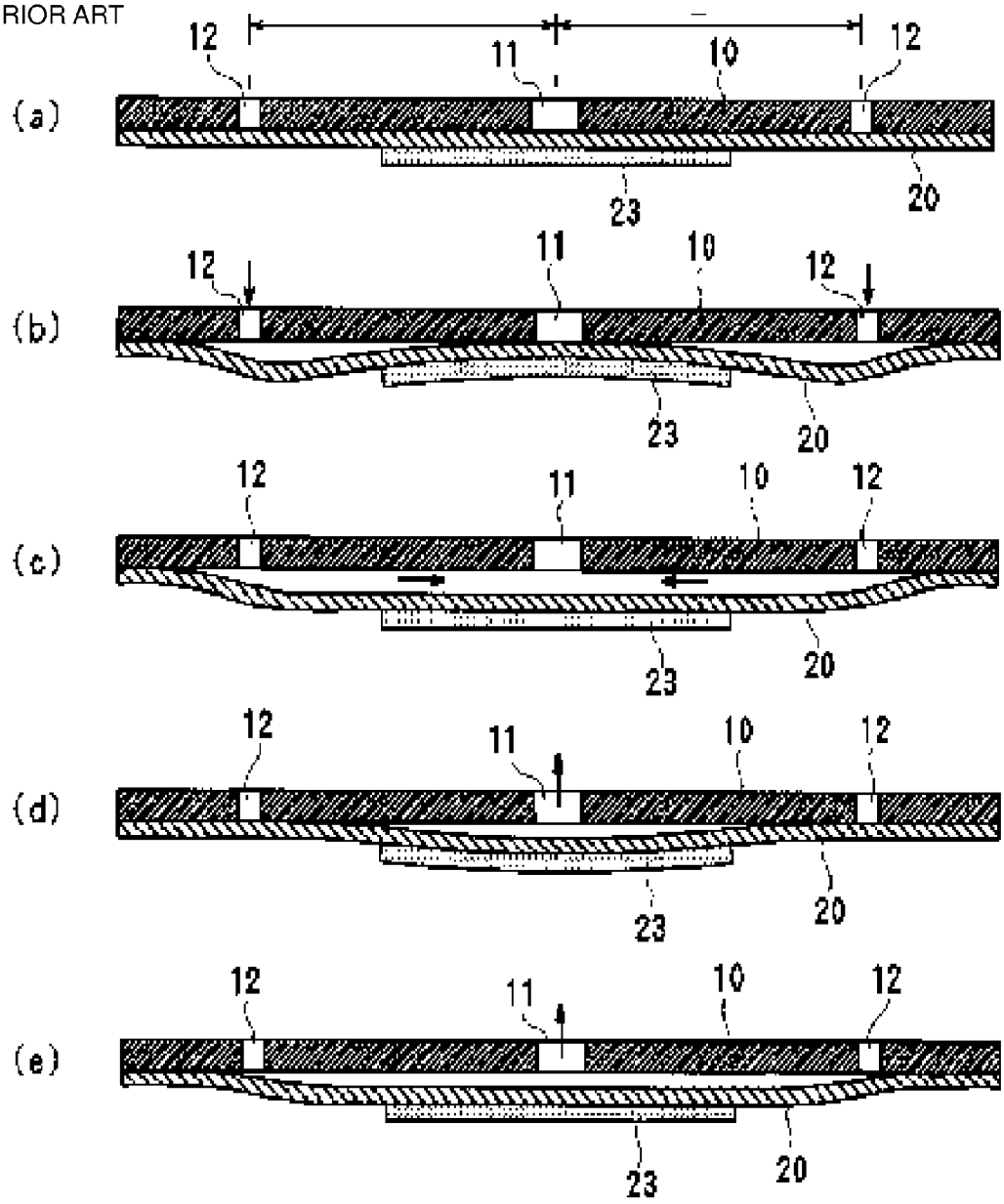
FIG. 10 PRIOR ART
FIG. 10 is a cross-sectional view of a principal portion of a fluid pump in PCT Publication No. 2008/069264.
Figure 11:
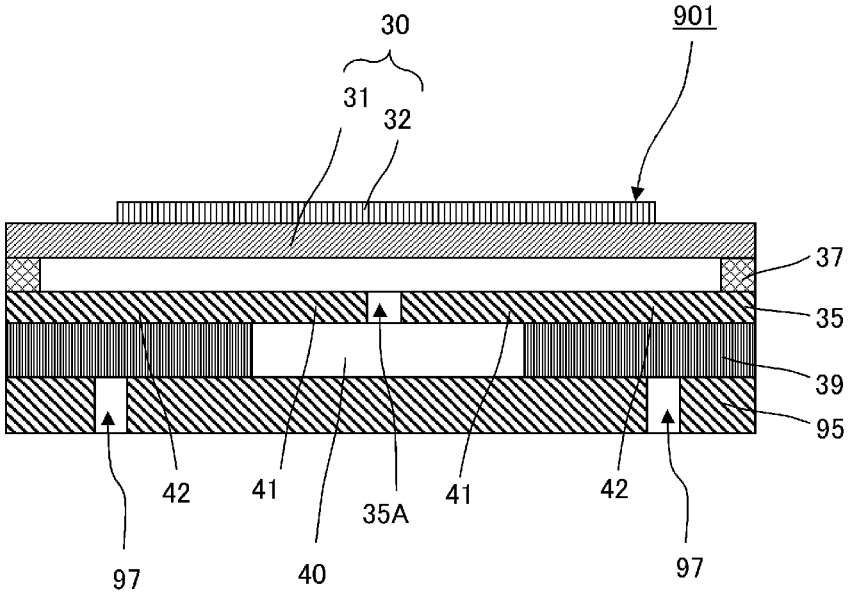
FIG. 11 is a cross-sectional view of a principal portion of a fluid pump 901 according to a comparative example of the present invention.

FIG. 9 is a graph showing characteristics of the piezoelectric pump 101. In FIG. 9, the vertical axis indicates the tensile stress of the flexible plate 151, and the horizontal axis indicates the interval between the piezoelectric actuator 140 and the flexible plate 151.

As described above, when the temperature of the piezoelectric pump 101 is increased, the operating point of the piezoelectric pump 101 shifts, for example, from the first operating point $L_0$ to the second operating point $H_0$ as shown in FIG. 9. Meanwhile, when the DC bias voltage is applied and the interval K is increased, the operating point of the piezoelectric pump 101 shifts, for example, from the first operating point $L_0$ to a fifth operating point $LD_0$.

Here, when the operating point of the piezoelectric pump 101 is above and close to the separation line h, for example, like the first operating point $L_0$, even if the operating point of the piezoelectric pump 101 shifts downward or rightward, the operation point is below the separation line h, and the pump pressure is rapidly decreased.

Thus, when the operating point of the piezoelectric pump 101 is above and close to the separation line h, if the DC bias voltage is applied and the interval K is increased, the operating point of the piezoelectric pump 101 shifts rightward, and hence the operating point is below the separation line h and the pump pressure is rapidly decreased.

Therefore, when the DC bias voltage is applied and the interval K is increased, it is possible to confirm whether or not the operating point of each piezoelectric pump 101 is above and close to the separation line h (in a mere 15 seconds, approximately), without driving a plurality of piezoelectric pumps 101 for a long time period (for example, about 300 seconds in the present preferred embodiment) in line with the actual usage environment, increasing the temperatures of the plurality of piezoelectric pumps 101 to nearly the upper limit of the above temperature range by generated heat, and then measuring the pump pressure of each piezoelectric pump 101.

For the piezoelectric pump 101 whose operating point is above and close to the separation line h, the pressing step is conducted in S4 in FIG. 4 similarly to the first adjusting method. By so doing, the tensile stress of the movable portion 154 is increased, and thus the operating point of the piezoelectric pump 101 shifts upward (for example, from the first operating point $L_0$ to the second operating point $L_1$).

The piezoelectric pump 101 that has passed through the pressing step in S4 in FIG. 4 is re-inspected in the inspecting step in which the pump pressure discharged from the piezoelectric pump 101 is measured and it is inspected whether the pump pressure is equal to or higher than the predetermined value (FIG. 4: S1 and S2), similarly to the first adjusting method.

Similarly to the above, when the DC bias voltage is applied and the interval K is increased, it is possible to confirm whether or not the operating point of each piezoelectric pump 101 is above and close to the separation line h.

When the DC bias voltage is applied and the interval K is increased, the operating point of the piezoelectric pump 101 shifts, for example, from the third operating point $L_1$ to a sixth operating point $LD_1$ as shown in FIG. 9. Here, if the pump pressure is equal to or higher than the predetermined value, this means that the movable portion 154 of the piezoelectric pump 101 is adjusted to have an optimum natural vibration frequency by the pressing step.

For example, if the operating point of the piezoelectric pump 101 is the sixth operating point $LD_1$ as shown in FIG. 9, this means that the movable portion 154 of the piezoelectric pump 101 is adjusted to an optimum natural vibration frequency by the pressing step. Then, such a piezoelectric pump 101 is determined as being non-defective, and the adjustment of the natural vibration frequency is ended.

Due to the above, according to the second adjusting method, it is also possible to conduct, in a short time, the inspecting step in which the pump pressure of the piezoelectric pump 101 is measured at a temperature higher than normal temperature.

Although the actuator 140 that flexurally vibrates is preferably provided as a unimorph type in the above preferred embodiments, the actuator 140 may be configured to flexurally vibrate as a bimorph type in which the piezoelectric device 142 is attached to both surfaces of the diaphragm 141.

In the above preferred embodiments, the driver preferably includes the piezoelectric device, and the actuator 140 that flexurally vibrates by expansion and contraction of the piezoelectric device 142 is provided, but the present invention is not limited to the above-described preferred embodiments. For example, an actuator that flexurally vibrates via an electromagnetic drive may be provided.

In the above preferred embodiments, the piezoelectric device 142 is preferably made of the PZT ceramic, but the present invention is not limited to the above-described preferred embodiments. For example, the piezoelectric device 142 may be made of a piezoelectric material of a non-lead piezoelectric ceramic such as potassium-sodium niobate or an alkali niobate ceramic, for example.

In the above preferred embodiments, the sizes of the piezoelectric device 142 and the diaphragm 141 preferably are the same or substantially the same, but the present invention is not limited to the above-described preferred embodiments. For example, the diaphragm 141 may be larger in size than the piezoelectric device 142.

In the above preferred embodiments, the disc-shaped piezoelectric device 142 and the disc-shaped diaphragm 141 preferably are used, but the present invention is not limited to the above-described preferred embodiments. For example, the shape of either the piezoelectric device 142 or the diaphragm 141 may be rectangular or substantially rectangular or polygonal or substantially polygonal.

In the above preferred embodiments, the connection portions 162 preferably are provided at the three locations, but the present invention is not limited to the above-described preferred embodiments. For example, the connection portions 162 may be provided at only two locations or at four or more locations. The connection portions 162 do not completely impede vibration of the actuator 140, but influence the vibration to some degree. Thus, when connection (retainment) is made at three locations, natural retainment is possible with the position kept with high accuracy, and it is also possible to prevent the piezoelectric device 142 from being fractured.

In applications of preferred embodiments of the present invention in which occurrence of audible sound does not become a problem, the actuator 140 may be driven in an audible frequency range.

In the above preferred embodiments, preferably a single air hole 152 is provided at the center of the region of the flexible plate 151 that faces the actuator 140, but the present invention is not limited to the above-described preferred embodiments. For example, a plurality of holes may be provided near the center of the region that faces the actuator 140.

In the above preferred embodiments, the frequency of the drive voltage preferably is set such that the actuator 140 is vibrated in the first-order mode, but the present invention is not limited to the above-described preferred embodiments. For example, the frequency of the drive voltage may be set such that the actuator 140 is vibrated in another mode such as a third-order mode.

In the above preferred embodiments, air is preferably used as the fluid, but the present invention is not limited to the above-described preferred embodiments. For example, the above preferred embodiments are applicable even when the fluid is any one of a liquid, a gas-liquid mixed fluid, a solid-liquid mixed fluid, a solid-gas mixed fluid, and the like.

Finally, the explanation of the above-described preferred embodiments is illustrative in all respects and is considered as not limiting. The scope of the present invention is indicated by the claims rather than by the above-described preferred embodiments. Furthermore, the scope of the present invention is intended to encompass all modifications within the equivalent meaning and scope with respect to the claims.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fluid control apparatus comprising:

a diaphragm unit including a diaphragm, a frame plate surrounding a periphery of the diaphragm, and a plurality of connection portions extending between and connecting the diaphragm and the frame plate;

a driver arranged on a principal surface of the diaphragm to vibrate the diaphragm;

a flexible plate including a hole and joined to the frame plate so as to face another principal surface of the diaphragm; and a cover member joined to a principal surface of the flexible plate on a side opposite to the diaphragm; wherein the frame plate and the diaphragm are coplanar;

the cover member includes at least one suction hole provided therein;

the fluid control apparatus includes a discharge hole;

the fluid control apparatus pumps fluid from the at least one suction hole through the hole in the flexible plate, and discharges the fluid through the discharge hole;

the at least one suction hole and the discharge hole are located on opposite sides of the diaphragm unit; and a central portion of the flexible plate is spaced away and separate from the cover member and tensile stress is added to the flexible plate by the cover member.

2. The fluid control apparatus according to claim 1, wherein the cover member includes a recess located at a center or approximately center thereof; and the flexible plate includes a movable portion that faces the recess of the cover member and flexurally vibrates, and a fixed portion that is joined to the cover member.

3. The fluid control apparatus according to claim 2, wherein a center portion of the cover member corresponding to a surface on a back side of the recess is pressed toward the diaphragm side.

4. The fluid control apparatus according to claim 3, wherein the cover member includes an indentation located on the center portion.

5. A method for adjusting a fluid control apparatus, comprising the steps of:

measuring a discharge pressure of a fluid discharged from the fluid control apparatus according to claim 4 by vibration of the diaphragm, and inspecting whether the discharge pressure is equal to or higher than a predetermined value; and pressing the principal surface of the cover member on the side opposite to the diaphragm when the discharge pressure is less than the predetermined value; wherein the pressing step further comprises the step of returning to the inspecting step after the pressing step.

6. A method for adjusting a fluid control apparatus, comprising the steps of:

measuring a discharge pressure of a fluid discharged from the fluid control apparatus according to claim 3 by vibration of the diaphragm, and inspecting whether the discharge pressure is equal to or higher than a predetermined value; and pressing the principal surface of the cover member on the side opposite to the diaphragm when the discharge pressure is less than the predetermined value; wherein the pressing step further comprises the step of returning to the inspecting step after the pressing step.

7. A method for adjusting a fluid control apparatus, comprising the steps of:

measuring a discharge pressure of a fluid discharged from the fluid control apparatus according to claim 2 by vibration of the diaphragm, and inspecting whether the discharge pressure is equal to or higher than a predetermined value; and pressing the principal surface of the cover member on the side opposite to the diaphragm when the discharge pressure is less than the predetermined value; wherein the pressing step further comprises the step of returning to the inspecting step after the pressing step.

8. The fluid control apparatus according to claim 1, wherein the cover member is an integral structure including a base plate that is joined at one principal surface thereof to the principal surface of the flexible plate on the side opposite to the diaphragm and includes an opening located at a center or approximate center thereof, and a cover plate that is provided on another principal surface of the base plate.

9. A method for adjusting a fluid control apparatus, comprising the steps of:

measuring a discharge pressure of a fluid discharged from the fluid control apparatus according to claim 8 by vibration of the diaphragm, and inspecting whether the discharge pressure is equal to or higher than a predetermined value; and pressing the principal surface of the cover member on the side opposite to the diaphragm when the discharge pressure is less than the predetermined value; wherein the pressing step further comprises the step of returning to the inspecting step after the pressing step.

10. The fluid control apparatus according to claim 1, further comprising an outer housing, wherein the cover member defines a portion of the outer housing.

11. A method for adjusting a fluid control apparatus, comprising the steps of:

measuring a discharge pressure of a fluid discharged from the fluid control apparatus according to claim 10 by vibration of the diaphragm, and inspecting whether the discharge pressure is equal to or higher than a predetermined value; and pressing the principal surface of the cover member on the side opposite to the diaphragm when the discharge pressure is less than the predetermined value; wherein the pressing step further comprises the step of returning to the inspecting step after the pressing step.

12. The fluid control apparatus according to claim 1, wherein the cover member is made of a ductile metallic material.

13. A method for adjusting a fluid control apparatus, comprising the steps of:

measuring a discharge pressure of a fluid discharged from the fluid control apparatus according to claim 12 by vibration of the diaphragm, and inspecting whether the discharge pressure is equal to or higher than a predetermined value; and pressing the principal surface of the cover member on the side opposite to the diaphragm when the discharge pressure is less than the predetermined value; wherein the pressing step further comprises the step of returning to the inspecting step after the pressing step.

14. The fluid control apparatus according to claim 1, wherein the diaphragm and the driver constitute a disc-shaped actuator.

15. A method for adjusting a fluid control apparatus, comprising the steps of: measuring a discharge pressure of a fluid discharged from the fluid control apparatus according to claim 14 by vibration of the diaphragm, and inspecting whether the discharge pressure is equal to or higher than a predetermined value; and pressing the principal surface of the cover member on the side opposite to the diaphragm when the discharge pressure is less than the predetermined value; wherein the pressing step further comprises the step of returning to the inspecting step after the pressing step.

16. A method for adjusting a fluid control apparatus, comprising the steps of:

measuring a discharge pressure of a fluid discharged from the fluid control apparatus according to claim 1 by vibration of the diaphragm, and inspecting whether the discharge pressure is equal to or higher than a predetermined value; and pressing the principal surface of the cover member on the side opposite to the diaphragm when the discharge pressure is less than the predetermined value; wherein the pressing step further comprises the step of returning to the inspecting step after the pressing step.

17. The method for adjusting the fluid control apparatus according to claim 16, wherein the pressing step further comprises the step of increasing a pressure to press the cover member each time the pressing step is repeated.

18. The method for adjusting the fluid control apparatus according to claim 17, wherein the inspecting step applies a drive voltage obtained by superimposing a DC bias voltage on an AC voltage, to the driver, increases an interval from the diaphragm to the flexible plate from that when the drive voltage is not applied to the driver, vibrates the diaphragm, and measures the discharge pressure.

19. The method for adjusting the fluid control apparatus according to claim 16, wherein the inspecting step applies a drive voltage obtained by superimposing a DC bias voltage on an AC voltage, to the driver, increases an interval from the diaphragm to the flexible plate from that when the drive voltage is not applied to the driver, vibrates the diaphragm, and measures the discharge pressure.

20. The fluid control apparatus according to claim 1, wherein the diaphragm, the frame plate, and the plurality of connection portions are integrally included in or defined by a single plate.

* * * * *